United States Patent [19]

Lampatzer et al.

[11] 4,169,741

[45] Oct. 2, 1979

[54] METHOD FOR THE SURFACE TREATMENT OF METALS

[75] Inventors: Karl Lampatzer; Werner Rausch, both of Oberursel, Fed. Rep. of Germany

[73] Assignee: Oxy Metal Industries Corporation, Warren, Mich.

[21] Appl. No.: 884,871

[22] Filed: Mar. 9, 1978

[30] Foreign Application Priority Data

Mar. 16, 1977 [DE] Fed. Rep. of Germany ..... 2711431

[51] Int. Cl.[2] ..... C23F 7/26

[52] U.S. Cl. ..... 148/6.16; 148/6.2

[58] Field of Search ..... 148/6.16, 6.2, 113

[56] References Cited

U.S. PATENT DOCUMENTS

| | | | |
|---|---|---|---|
| 3,421,949 | 1/1969 | Halversen | 148/6.2 |
| 3,562,011 | 2/1971 | Hirst et al. | 148/113 UX |
| 3,705,826 | 12/1972 | Hirst et al. | 148/6.16 |
| 3,706,603 | 12/1972 | Vessey et al. | 148/6.2 |
| 3,720,549 | 3/1973 | Hirst et al. | 148/6.16 |

*Primary Examiner*—Ralph S. Kendall

*Attorney, Agent, or Firm*—Arthur E. Kluegel; Richard P. Mueller

[57] ABSTRACT

An aqueous acidic composition free of hexavalent chromium is employed to treat a metal surface. The composition contains trivalent chromium, phosphate ion and dispersed silica.

7 Claims, No Drawings

METHOD FOR THE SURFACE TREATMENT OF METALS

BACKGROUND OF THE INVENTION

In the chemical surface treatment of metals, for example as a preparation for the application of lacquers, adhesives and other synthetic or resinous materials, increasing importance is being given to so-called 3-stage methods. In the first stage of such methods, the surface of the metal is cleaned in order to eliminate oil, dirt and corrosion products; in the second stage, the metal surface is rinsed with water in order to remove any chemical residues left by the first stage; finally, in the third stage, the metal surface is wetted with an aqueous chemical reaction solution, and the film of liquid is then dried. This leaves, on the metal, a thin, non-metallic coating which can effect a decisive improvement in surface quality, if the composition of the solution and the reaction conditions are appropriate. Coatings of lacquers, adhesives and other synthetic or resinous materials, for example, may therefore adhere better and may provide considerably better corrosion protection, if they are applied to metal thus pretreated.

German Public Inspection Text No. 17 69 582 described a method in which an aqueous solution containing hexavalent chromium, trivalent chromium, alkali cations and silicon dioxide in specific ratios is dried upon the metal. The coatings formed are highly suitable as electrical insulation, protection against corrosion and as an adhesive base for lacquers and the like. One major disadvantage of this method, however, is the presence of hexavalent chromium which, because of its toxic and carcinogenic properties, makes special precautions necessary during application of the layer-forming solution and in the handling of the coated metal.

U.S. Pat. No. 2,030,601 discloses another method in which highly concentrated aqueous solutions, containing from 10 to 20% of phosphoric acid, from 10 to 15% of sodium dichromate and, possibly, silicic acid, are brushed onto iron surfaces and are then dried. This treatment provides protection against the formation of rust, but here again the known precautions for handling hexavalent chromium must be taken. The use of chromium salts, in which the chromium is present in the form of the base ion, is not advised because the corrosion protection provided thereby is inadequate and the appearance of the coating is unsatisfactory.

SUMMARY OF THE INVENTION

The method according to the invention makes use of a solution which contains no hexavalent chromium and is therefore much easier and less dangerous to use. Furthermore, the said solution produces uniform coatings of high quality, and may be used for the surface treatment of metals, more particularly iron, zinc and aluminum, for example in preparing the said metals for the application of lacquers, adhesives and other synthetic or resinous materials. The cleaned metal surface is wetted with an aqueous solution containing chromium III ions, phosphate ions and finely divided silicic acid (silica). The film of solution is then dried, preferably at a higher temperature.

DETAILED DESCRIPTION OF THE INVENTION

Metal workpieces to be treated in accordance with the method of the invention may be in the widest variety of forms, e.g., foreign bodies, pipes, rods, wires, sheet metal or strip metal. However, preferred shapes are those which permit uniform mechanical distribution of the film of solution, e.g., by squeegee-rolling, brushing or centrifuging. The method is particularly easy to use on sheet and strip metal. Metals most commonly treated are iron, zinc and aluminum, pure or in the form of alloys, the said metals constituting either the whole workpiece or merely a thin surface layer thereon, e.g., coatings of Al, Al-Zn or Zn on iron.

For the application of the treatment according to the invention, the surface of the metal must be clean, since films of oil, for instance, prevent uniform wetting of the surface. Coatings of dust and dirt would lead to defective areas of lower quality in the coating after the treatment. The formation of the coating is also impaired by thick layers of oxide, although thin oxide layers, like temper colours or less, are generally acceptable.

The essential components of the acid aqueous solutions used according to the invention are chromium III ions, phosphate ions and finely divided silicic acid (silica). The chromium III ions may be introduced into the solution in the form of chromium III salts with non-detrimental anions, e.g., acetate, maleate, or phosphate. Introduction is also possible, for example, by reducing chromium VI ions with sugar, starch, methanol, oxalic acid and the like. The phosphate is preferably added in the form of phosphoric acid and/or chromium III phosphate. Satisfactory sources of finely divided silicic acid have been found to be, for example, silicic acid obtained pyrogenically from silicon tetrachloride, and silicic acid precipitated in an aqueous medium from alkali silicates. Silicic acid of small grain size is essential since this ensures a uniform stable suspension in the aqueous acid reaction solution.

Wetting of the metal surfaces may be achieved in any conventional manner, for example, by immersion and subsequent draining, flooding and centrifuging, brushing, spraying with compressed air, "air-less" and also electrostatic, sprinkling, and rolling with structured and smooth rolls running in the same direction or in the opposite direction.

The solutions used according to the invention contain the components in amounts such as to produce a residue from evaporation of between 5 and 150 g/l. The film of liquid used for wetting is preferably between 2.5 and 25 ml per square meter of workpiece surface. Satisfactory technical results may be obtained, for example, with a dried layer weighing between 0.03 and 0.6 g/m$^2$ of workpiece surface. The film of solution is then dried on the surface of the metal. Although this may be done at room temperature, better results are obtained with a higher temperature, preferably with the specimens at a temperature of between 70 and 300° C.

The solutions used according to the invention may contain zinc and/or manganese ions as additional components. The quantities of the individual components of the solution are preferably such that the molar ratio Cr-III:$PO_4$:(acetate and/or maleate):$SiO_2$ is as 1:(0.3 to 30):(0 to 5):(0.5 to 10), and that the molar ratio Cr-III:($PO_4$+acetate and/or maleate) is of the order of 1:(0.7 to 30). Zinc ions and/or manganese ions are preferably added in a molar ratio of Cr-III:(Zn and/or Mn)=1:(0 to 3).

The method according to the invetnion is now explained by means of the following examples:

EXAMPLE 1

2.1 g/l. Cr-III (trivalent chromium); 48 g/l. $PO_4$ (Phosphate); 2.1 g/l. $CH_3CO_2$ (Acetic Acid); 10 g/l. $SiO_2$

MOLAR RATIOS:

(a) Cr-III:$PO_4$:$CH_3O_2$:$SiO_2$=1:12.6:0.9:4.3

(b) Cr-III:($PO_4$+$CH_3CO_2$)=1:13.5

Residue From Evaporation: ca. 65 g/l.

EXAMPLE 2

3.6 g/l. Cr-III; 29 g/l. $PO_4$; 3.5 g/l. $Ch_3CO_2$; 10 g/l. $SiO_2$

MOLAR RATIOS:

(a) Cr-III:$PO_4$:$CH_3CO_2$:$SiO_2$=1:4.4:0.9:2.5

(b) Cr-III:($PO_4$+$CH_3CO_2$)=1:5.3

Residue From Evaporation: ca. 50 g/l.

EXAMPLE 3

5 g/l. Cr-III; 9.7 g/l. $PO_4$; 4.9 g/l. $CH_3CO_2$; 10 g/l. $SiO_2$

MOLAR RATIOS:

(a) Cr-III:$PO_4$:$CH_3CO_2$:$SiO_2$=1:1.04:0.9:1.7

(b) Cr-III:($PO_4$+$CH_3CO_2$)=1:1.94

Residue From Evaporation: ca. 40 g/l.

EXAMPLE 4

5 g/l. Cr-III; 9.7 g/l. $PO_4$; 0.9 g/l. $CH_3CO_2$; 15 g/l. $SiO_2$

MOLAR RATIOS:

(a) Cr-III:$PO_4$:$CH_3CO_2$:$SiO_2$=1:1.04:0.9:2.6

(b) Cr-III:($PO_4$+$CH_3CO_2$)=1:1.94

Residue From Evaporation: ca. 35 g/l.

EXAMPLE 5

5 g/l Cr-III; 9.7 g/l. $PO_4$; 4.9 g/l. $CH_3CO_2$; 20 g/l. $SiO_2$

MOLAR RATIOS:

(a) Cr-III:$PO_4$:$CH_3CO_2$:$SiO_2$=1:1.04:0.9:3.4

(b) Cr-III:($PO_4$+$CH_3CO_2$)=1:1.94

Residue From Evaporation: ca. 40 g/l.

EXAMPLE 6

5 g/l. Cr-III; 29 g/l. $PO_4$; 4.9 g/l. $CH_3CO_2$; 10 g/l. $SiO_2$

MOLAR RATIOS:

(a) Cr-III:$PO_4$:$CH_3CO_2$:$SiO_2$=1:3.2:0.9:1.7

(b) Cr-III:($PO_4$+$CH_3CO_2$)=1:4.1

Residue From Evaporation: ca. 50 g/l.

EXAMPLE 7

5 g/l. Cr-III; 9.7 g/l. $PO_4$; 4.9 g/l. $CH_3CO_2$; 5.5 g/l. $(:CH\text{-}CO_2)_2$ (Maleate); 10 g/l. $SiO_2$

MOLAR RATIOS:

(a) Cr-III:$PO_4$: ($CH_3CO_2$+$(:CH\text{-}CO_2)_2$): $SiO_2$=1:1.04:1.4:1.7

(b) Cr-III:($PO_4$+$CH_3CO_2$+$(:CH\text{-}CO_2)_2$)=1:2.44

Residue From Evaporation: ca. 35 g/l.

EXAMPLE 8

3.6 g/l. Cr-III; 29 g/l. $PO_4$; 10 g/l. $SiO_2$

MOLAR RATIOS:

(a) Cr-III:$PO_4$:$SiO_2$=1:4.4:2.5

(b) Cr-III:$PO_4$=1:4.4

Residue From Evaporation: ca. 32 g/l.

EXAMPLE 9

5 g/l. Cr-III; 9.7 g/l. $PO_4$; 4.9 g/l. $CH_3CO_2$; 10 g/l. $SiO_2$; 1.7 g/l. Zn

MOLAR RATIOS:

(a) Cr-III:$PO_4$:$CH_3CO_2$:$SiO_2$=1:1.1:0.9:1.7

(b) Cr-III:$PO_4$=1:1.1

(c) Cr-III:Zn=1:0.27

Residue From Evaporation: ca. 32 g/l.

EXAMPLE 10

5 g/l. Cr-III; 9.7 g/l. $PO_4$; 4.9 g/l. $CH_3CO_2$; 10 g/l. $SiO_2$; 1.4 g/l. Mn

MOLAR RATIOS:

(a) Cr-III:$PO_4$:$CH_3CO_2$:$SiO_2$=1:1.1:0.9:1.7

(b) Cr-III:$PO_4$=1:1.1

(c) Cr-III:Mn=1:0.26

Residue From Evaporation: ca. 32 g/l.

With the exception of Example 8, the Cr-III was introduced into the solutions in the form of basic chromium acetate, the $PO_4$ in the form of thermal phosphoric acid, the $SiO_2$ in the form of pyrogenic finely divided silicic acid, the Mn in the form of MnO and the Zn in the form of ZnO. The maleic acid was introduced as such.

Solutions 1 to 10 were applied, by means of a roll-frame with counter-rotating rolls, to sheets of metal previously subjected to alkaline spray degreasing, rinsing in water and squeezing between rubber rolls. The sheets were raised to a temperature of 80° C. by placing them for 17 sec. in a 220° C. furnace; they were then raised to a temperature of 200° C. by placing them for 90 sec. in a 240° C. furnace. The coatings produced weighed between 0.1 and 0.2 g/m$^2$. The color of the coatings on steel was blue-gray and, on aluminum and galvanized steel, grey.

The test pieces thus pretreated were coated with an acrylate lacquer and a polyester "coil-coating" lacquer and were tested for adhesion by means of a bend-test and, for resistance to corrosion by means of the ASTM B 117 salt-spray test. These tests produced technological values showing results, with the method according to the invention, at least equivalent to, and some even rather better than, those obtained with solutions based upon the known Cr-VI/Cr-III/$SiO_2$.

What is claimed is:

1. A hexavalent chromium-free process for treating a metal surface to prepare the surface for the application of lacquers, adhesives and other synthetic or resinous materials comprising contacting the surface with an aqueous acidic composition consisting essentially of trivalent chromium, phosphate and dispersed silicic acid wherein the molar ratio of Cr-III:$PO_4$:$SiO_2$ equivalent is 1:0.3–30:0.5–10 in an amount sufficient to yield a dry film weight of up to 0.6 g/m$^2$ of metal surface and thereafter drying the film without rinsing the surface.

2. The process of claim 1 wherein the composition additionally comprises at least one component selected from the group consisting of acetate ions, and maleate ions wherein the molar ratio of Cr-III:acetate and/or maleate ion is 1:0–5.

3. The process of claim 2 wherein the molar ratio of Cr-III:($PO_4$+ acetate and/or maleate) is 1:0.7–30.

4. The process of claim 1 wherein the evaporation residue of the composition is from 5 to 150 g/l.

5. The process of claim 1 wherein the composition is applied in an amount sufficient to yield a dry film weight of at least 0.03 g/m$^2$ of metal surface.

6. The process of claim 1 wherein the composition is dried at a temperature of from 70°–300° C.

7. The process of claim 1 wherein the composition additionally contains at least one component selected from the group consisting of zinc ions and manganese ions wherein the molar ratio of Cr-III:zinc and/or manganese ion is 1:0–3.

* * * * *